US007987026B2

(12) United States Patent
Yi

(10) Patent No.: US 7,987,026 B2
(45) Date of Patent: Jul. 26, 2011

(54) RAILROAD TRACK MODEL SERVOMOTOR TYPE CONTROL SYSTEM

(76) Inventor: Yu-Meng Yi, Pingjhen (TW)

( * ) Notice: Subject to any disclaimer, the term of this patent is extended or adjusted under 35 U.S.C. 154(b) by 1029 days.

(21) Appl. No.: 11/772,242

(22) Filed: Jul. 1, 2007

(65) Prior Publication Data

US 2009/0005922 A1 Jan. 1, 2009

(51) Int. Cl.
*G05D 1/00* (2006.01)

(52) U.S. Cl. ..... 701/19

(58) Field of Classification Search ..... 701/19–20; 246/437 R, 1 R

See application file for complete search history.

(56) References Cited

U.S. PATENT DOCUMENTS

2006/0200280 A1 * 9/2006 Kono et al. ..... 701/19

* cited by examiner

*Primary Examiner* — Yonel Beaulieu
(74) *Attorney, Agent, or Firm* — Chun-Ming Shih

(57) ABSTRACT

A servomotor type control system for a railroad track model includes a CPU, a key unit, and multiple servos; a player of the model achieves control operating status of those servos as desired by operating the key unit in conjunction with programming pre-installed in the CPU; accordingly, multiple point rails can be easily controlled and adjusted; the servo relates to a servomotor to allow rail switching highly imitating life situation as a breakthrough of conventional restriction to significantly upgrade delicate sense and precision of a railroad track model.

4 Claims, 4 Drawing Sheets

RAILROAD TRACK MODEL SERVOMOTOR TYPE CONTROL SYSTEM

BACKGROUND OF THE INVENTION (a) Field of the Invention

The present invention is related to an integrated system operated in a railroad track model for switching point rail, switch signal, or level crossing, and more particularly, to one achieving the control by a servomotor.

(b) Description of the Prior Art

Train railroad track models generally available in the market involve making real traffic facilities into imitating miniature models including track, train on the track driven by electric energy, and point rail, crossing, related signals and environments to deliver sense of real situation for meeting imitation requirements. In a railroad track model of the prior as illustrated in FIG. 1 of the accompanying drawings, point rail controlling always operate by means of a stepping motor or an EM structure. The stepping motor or the EM structure usually is in a large size, which prevents easy installation and summary speed regulation, and involves complicate wiring. Even a player has to design on own efforts associate electronic devices; other players who do not command a certain level of electrics are unable to complete the installation of the railroad track model. Furthermore, existing control systems are found with poor coordination making operating set up extremely tedious and strenuous.

SUMMARY OF THE INVENTION

The present invention is to provide an integrated control system for a railroad track model to facilitate controlling and switching of multiple point rails or signals in the railroad track model. To achievement the purpose, the present invention of a railroad track servomotor type control system includes a CPU, a key unit, and multiple servos. The key unit permits a player to control and setup for deciding operation status of multiple servos as desired in conjunction with CPU programming.

The servo is made in a servomotor structure operating in conjunction with the CPU and the key unit to not only switch tracks but also adjust moving rate of the tracks, thus to allow easy performance of track switching at lower speed to better imitate real situation to satisfy players searching for a summary ways in approaching real requirements while the prior art permits only fast track switching based on a step motor.

The present invention by simply using a single key unit achieves integrated control to allow very easy and convenient setup and operation.

DETAILED DESCRIPTION OF THE PREFERRED EMBODIMENTS

Figure 1:
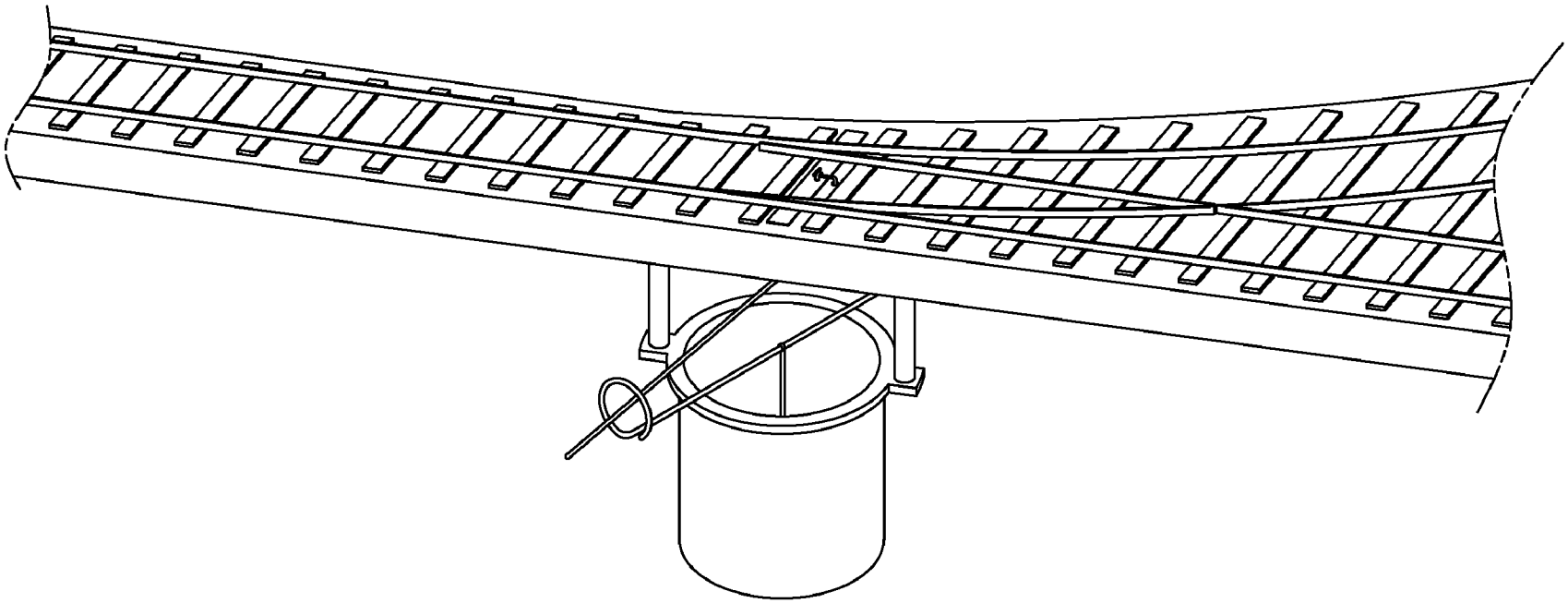
Fig.1 (Prior Art)
FIG. 1 is a perspective view of the prior art.
Figure 2:
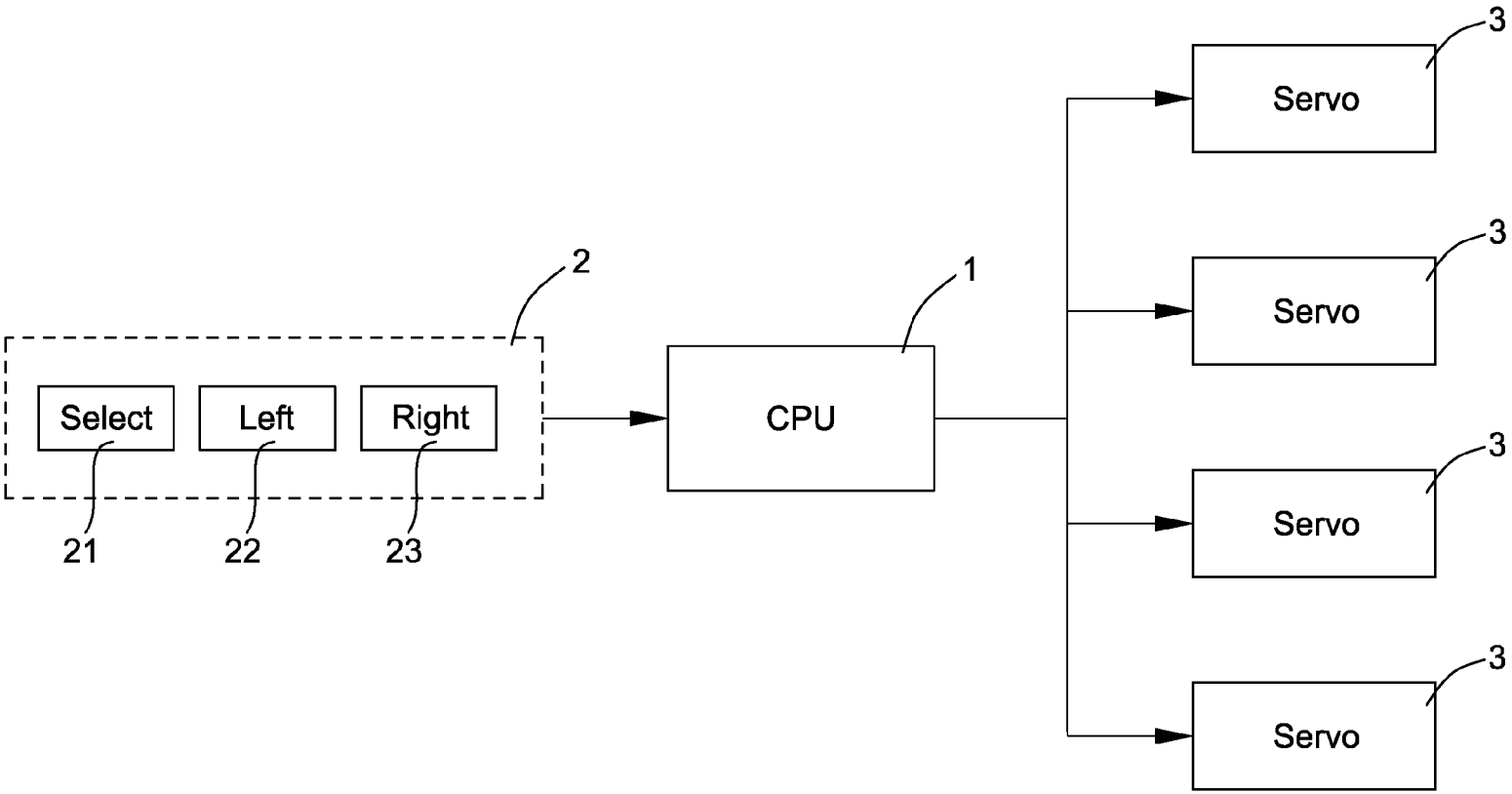
FIG. 2 is a block chart showing a system configuration of the present invention.

Referring to FIG. 2 for a block chart showing a configuration system of a preferred embodiment of the present invention, a railroad track servo type control system is essentially comprised of a central control unit (CPU) 1, key unit 2, and multiple servos 3.

The CPU 1 is a core of the system containing pre-installed programs.

The key unit 2 connected to the CPU 1 to command the CPU 1 to send specific electronic signals according to setting of the key unit 2. In the preferred embodiment, the key unit 2 includes three keys, respectively SELECT 21, LEFT 22, and RIGHT 23 though without limitation in practical application. The key unit 2 may be further provided with a display device, i.e., an LED digital display device to display setup status.

Four servos 3 are provided in the preferred embodiment though without limitation in practical application. The servo 3 controlling point rail, switch signal, crossing signal, etc., is related to a servomotor to receive electronic signals transmitted from the CPU 1 and capable of engaging in positive revolution for output, inverse revolution for output, and modulation of revolution speed.

Figure 3:
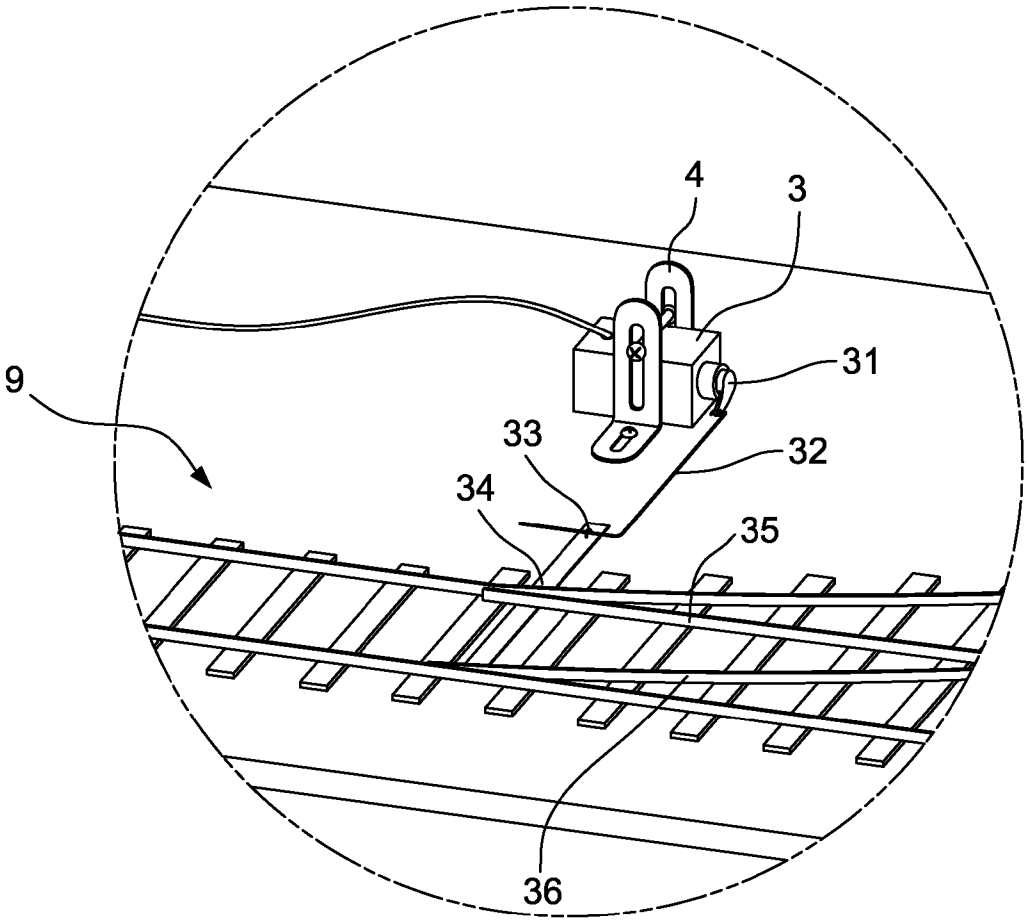
FIG. 3 is a schematic view showing a disposition of a servo adapted in the present invention.

Now referring to FIG. 3 for a disposition of the servo 3 in the present invention, the servo 3 is fixed to where appropriate by a roadbed 9 by means of an L brace 4; a servo horn 31 is disposed to an output axle of the servo 3; the servo horn 31 is linked to a steel rod 32; a terminal of the steel rod 32 is coupled to a hook 33; the hook 33 is provided on a switch rod 34; and the switch rod 34 controls movement of two point rails 35, 36. Accordingly, when the servo 3 is activated, its output axle causes the servo horn 31 to swing for a certain angle thus to drive the steel rod 32 to travel to change positions of both point rails 35, 36 for achieving the purpose of adjusting both point rails 35, 36. As illustrated in FIG. 3, the servo 3 is disposed at where by the roadbed 9.

Figure 4:
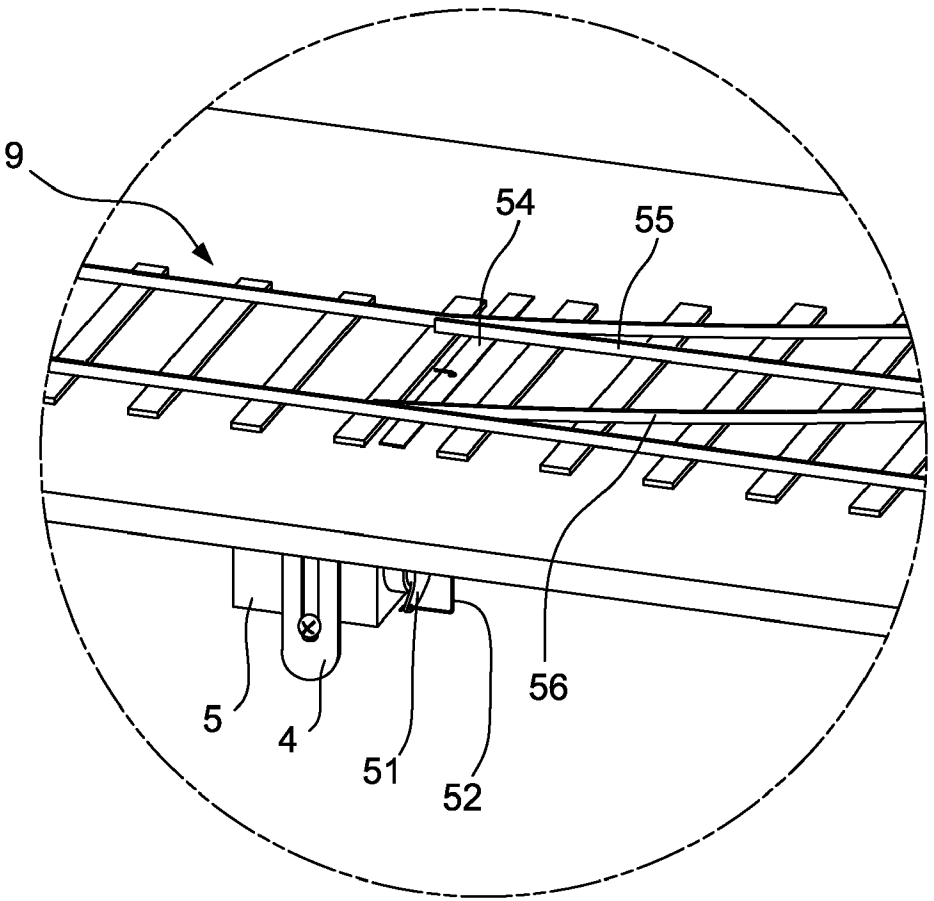
FIG. 4 is a schematic view showing another disposition of the servo adapted in the present invention.

Alternatively, a servo 5 is disposed at where appropriately beneath the roadbed 9 as illustrated in FIG. 4 by means of the L brace 4; a servo horn 51 is provided to an output axle of the servo 5; the servo horn 51 is linked to a steel rod 52; a terminal at a top of the steel rod 52 is upwardly connected to where between a sleeper and the switch rod 54; and the switch rod 54 controls movement status of two point rails 55, 56.

The invention claimed is:

1. A servomotor type control system for a railroad track model, comprising:

a central processing unit (CPU) with pre-installed programs;

a key unit connected to the CPU for the CPU to send specific electronic signals according to setting of the key unit;

a servomotor to receive electronic signals transmitted from the CPU to change operation status of an output axle of the servomotor in positive revolution output, inverse revolution output, or modulation of revolution speed;

an L-shaped brace to fix the servomotor at where appropriately by a roadbed of the railroad track model;

a servo horn disposed to the output axle of the servomotor;

a steel rod linked to the servo horn;

a hook engaged with a terminal of the steel rod; and a switch rod for the hook to be disposed thereon so that the switch rod is linked to and causes a point rail of the railroad track model to move.

2. The servomotor type control system for a railroad track model as claimed in claim 1, wherein the key unit is comprised of three keys, respectively SELECT key, LEFT key, and RIGHT key.

3. The servomotor type control system for a railroad track model as claimed in claim 1, wherein a display device is disposed at where appropriately to the key unit.

4. The servomotor type control system for a railroad track model as claimed in claim 3, wherein the display device relates to an LED digital display.

* * * * *